United States Patent [19]

Feaster

[11] 4,036,387

[45] July 19, 1977

[54] PREPARING BLOOD AND LIKE SAMPLES

[76] Inventor: William Wardock Feaster, L'Estoril, Princesse Grace Avenue, Monte Carlo, Monaco

[21] Appl. No.: 635,212

[22] Filed: Nov. 25, 1975

[51] Int. Cl.[2] ..... B65D 51/16

[52] U.S. Cl. ..... 215/309; 215/307; 215/311

[58] Field of Search ..... 215/307, 309, 311, 228; 220/231, 312, 361

[56] References Cited

U.S. PATENT DOCUMENTS

| | | | |
|---|---|---|---|
| 958,169 | 5/1910 | Pilz | 215/307 |
| 2,421,313 | 5/1947 | Brandon | 215/309 |
| 2,503,429 | 4/1950 | Ziegler | 220/231 |
| 2,770,235 | 11/1956 | Nesset | 215/309 |
| 3,512,806 | 5/1970 | Romney | 215/309 |
| 3,855,997 | 12/1974 | Sauer | 215/309 |

*Primary Examiner*—Ro E. Hart

*Attorney, Agent, or Firm*—Lawrence E. Laubscher

[57] ABSTRACT

Apparatus for use in blood and like sampling comprises a container and a fitting closure. The blood can be transferred to and from the container without removal of the closure. The container has a shelf to provide a sealing surface for the bottom of the closure which is received in an upper portion of the container. The closure is provided with passageways and is removable from a closed position in which the passageways are sealed against the shelf and a position which allows passage of blood to and from the lower portion of the container. The upper portion of the container can be of larger diameter than the lower portion and can be either concentric or eccentrically located with respect to the lower portion. An adaptor for use with the apparatus is also disclosed which allows a blood sample to be aspirated directly from a vein into the container through closure.

16 Claims, 9 Drawing Figures

PREPARING BLOOD AND LIKE SAMPLES

The present invention relates to apparatus for preparing blood and like samples.

In the past, it has been suggested to prepare blood samples by withdrawing a sample of blood from a patient by means of a syringe and then transferring blood to a test tube or the like, which is then closed; another suggestion is to use a closed evacuated tubes and to penetrate the closure of the test tube by a needle cannula. In both cases, to allow samples to be taken from the test tube for subsequent analysis the closure has be removed. The transfer of blood to an from an open test tube and the removal of the closure after it has come to contact with blood in the test tube is undesirable, in that it puts personnel handling the tubes at risk to infection.

The present invention provides comprising a container and a fitting closure, the container comprising a first and a second portion with a sealing surface at the junction between said container portions, the first container portion being arranged to receive the closure which is provided with at least one passageway for passage of fluid to and from said second portion, and the closure being movable between two positions, in the first of which an end of the passageway is sealed against the sealing surface and in the second of which said end of the passageway opens into the second portion of the chamber.

A container for blood or the like is provided to and from which liquid e.g. blood can be transferred without removal of the closure.

Features and advantages of the invention will become apparent from the following description of an embodiment thereof given by way of example, and the accompanying drawings, in which.

The apparatus comprising a container and a fitting closure which is provided with at least one and preferably two passageways. By moving, specifically rotating, the closure with respect to the container, the passageway can be brought into and out of registration with an opening to a fluid holding portion of the container thereby permitting access to and from the container. When the passageways are in register with the opening, fluid, in this case blood, can be introduced into or removed from the container and air can be released from or allowed into the container; in a further position the passageways are brought into register with a sealing surface of the container to close the passageways and prevent fluid flow either to or from the container.

Figure 1:
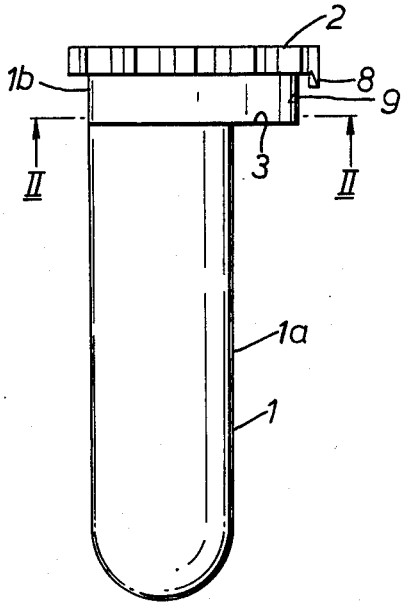
FIG. 1 is a side view of a container with a closure in position.

Referring now to the drawings, and in particular to FIGS. 1 to 4, the apparatus comprises a container 1 for a volume of blood and a closure 2 for closing the upper end of the container. The lower part of the container 1*a* as shown in FIG. 1 is of cylindrical shape, circular in cross section; the upper part 1*b* is also of cylindrical shape, but is of larger diameter and is eccentric with respect to the lower portion 1*a*. In this way, the upper part of the container forms a right cylindrical recess, which is adapted to receive the closure 2. The container defines a sealing surface or shoulder 3 at the junction of the upper and lower part against which the lower face of the closure bears when the closure is inserted in the upper part of the container.

The closure is provided with two passageways identified by numerals 5 and 6; these passageways each extend from an aperture in the bottom of the closure to an aperture in the top of the closure. The passageway 6 is arranged to be an air way, and the passageway 5 is arranged to allow blood to be put into or taken from the container.

The closure can be rotated in the recess, between two different postions. The first of these positions is the sealing position which is shown in FIG. 2 and in which the apertures in the bottom of the closure are over the surface of shoulder 3 of the container and the corresponding passageways in the closure are sealed.

Figure 2:
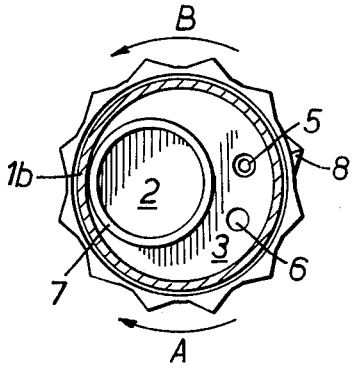
FIG. 2 is a sectional bottom plan view of the closure and part of the container taken along the line II—II in FIG. 1.

The closure can be rotated in the direction of the arrow A in FIG. 2 to its second position. The closure extends out of the end of the container by a distance sufficient to allow the closure to be gripped and rotated. In this second position of the closure, the passageways 5 and 6 are brought into register with the opening to the portion 1*a* of the container 1. In this position blood can be inserted into the portion 1*a* of the container by inserting a suitable device, for example a syringe adaptor, into the passageway 5 in the closure and then expelling blood into the container; air is expelled through passageway 6. It is preferred that the device should extend completely through the pasageway 5 and the bottom opening of the passageway is provided with a portion of reduced area (not shown) to form a wiping member for wiping the exterior of the device as it is withdrawn and thus reduce contamination risks. When the required amount of blood has been inserted into the container, the device is removed and the closure 2 is turned in the direction of arrow B back to the first position when the ends of the passageways 5 and 6 are sealed. This is achieved primarily by a depending ring 7 (FIG. 2) which is arranged to be a sealing fit in the opening to the portion 1*a* of the container. Additionally, the ends of the passageways are sealed against the surface of the shoulder 3. This shuts off any flow of blood from the container into the closure fluid passageway. The container may then be rotated to mix the blood with any additives similarly introduced.

The removal of blood from the container is carried out in a similar manner using a syringe, or an automatic blood sampling device or some other suitable device.

The closure 2 will now be described in more detail. As will be seen from FIG. 3 it comprises a head portion 2*a* and a body portion 2*b* the height of the body portion is such that when the closure is in position in the portion 1*b* of the container, the bottom of the closure 2 rests on the shoulder 3 of the container.

To assure proper sealing, the bottom of the closure 2 is provided with the depending ring 7 (FIG. 2) which is arranged to be received in the opening to the portion 1*a* of the container. Alternatively, the opening to the portion 1*a* can be provided with a raised lip which can either be received in an annular groove in the bottom of the closure, or else, if the closure is made of a suitably resilient material, can simply locally deform the bottom of the closure to provide an adequate seal.

The exterior of the closure provided with indicia 8 for ensuring that the user fully opens and closes the passageways and therefore, the container is also provided with reference marks 9 only one of which is shown. Indicia can also be provided for indicating the liquid passageway where the construction of the passageways is not identical.

Figure 5:
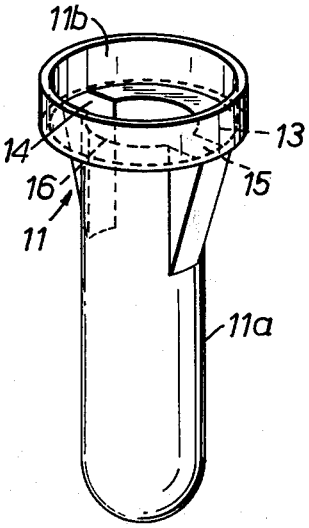
FIG. 5 is a perspective view of a further container.
Figure 4:
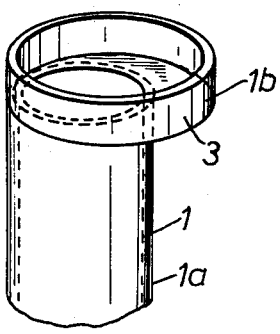
FIG. 4 is a perspective view of a part of the container of FIG. 1.

Referring now to FIG. 5 of the drawings, the apparatus of this embodiment comprises a container 11 for a volume of blood. The lower part of the container 11*a* as shown in FIG. 5 is of cylindrical shape, circular in cross section; the upper part 11*b* is also of cylindrical shape, but is of larger diameter and is concentric with respect to the lower portion 1*a*. In this way, the upper part of the container forms a right-cylindrical recess, which is adapted to receive a closure (not shown). The container defines an annular shoulder 13 at the junction of the upper and lower parts against which the lower face of the closure bears when the closure is inserted in the container.

Two angled channels 14 and 15 connect the upper part 11*b* of the container with the lower part 11*a* of the container. As with the previous embodiment, into order to assure a proper seal between the junction of the upper and lower parts of the container and the closure, the junction can be formed with a projection 16 extending into the upper part of the container for engagement with the closure or else the closure can be formed with a depending annular sealing member.

Figure 3:
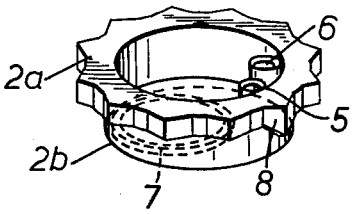
FIG. 3 is a perspective view of the closure shown in FIG. 1.

A closure for use with this container will be generally similar to that shown in FIG. 3 but the disposition of the passageways will be altered to suit the disposition of the channels 14 and 15. When the closure is inserted into the upper part 11*b* of the container, it rests on the surface 13 and the projection 16 ensures that the lower part 11*a* is sealed from the upper part 11*b* of the container. The closure also is a sealing fit against the inner side of the upper part 11*b* of the container. A part spherical recess may be provided on the bottom of the closure to aid mixing of additives with the fluid in the container. This recess can also be provided in the closure 2 shown in FIG. 3.

In use the closure is rotated in the upper part 11*b* of the container until the passageways in the closure are aligned with the angled channels 14, 15 of the container to give open access to the lower part 11*a* of the container through the passagways in the closure. A syringe or other means for introducing blood into the container is connected to the liquid passageway. Blood is transferred into the lower portion 11*a* of the container with the other passageway of the closure acting as an air vent. When the desired volume of blood has been put into the container, the closure is rotated so that the passageways in the closure are no longer aligned with the angled channels in the container and are therefore sealed against the shoulder 13.

The container can be placed on a mixer or rotator and the blood mixed with additives in the container. When mixing is completed, the closure is rotated again until the passageways are again aligned with the angled channels in the container. Blood may then be aspirated out of the tube in a similar manner to that used for putting blood into the container. When the desired volume of blood has been aspirated, the closure can be rotated again sealing the passageways. The sealed container can be retained if blood remaining in the container is to be further analyzed or the tube can be destroyed.

In the previous embodiments, the upper and lower portions of the container were clearly distinguishable due to the differences in diameter of the portions. In the embodiments to be described the sealing surface extends transversely into the bore of the container and divides the bore into two portions, one for the closure and the other for liquid, e.g. blood. The sealing surface may extend over the whole area of the bore and be provided with one or more orifices to allow blood to be inserted through the closure into the container or alternatively can cover only a portion of the area of the bore.

Figure 6:
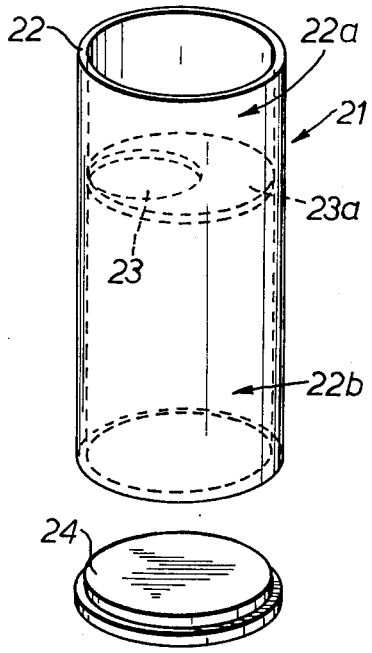
FIG. 6 is an exploded perspective view of yet another container.

Referring now to FIG. 6 of the drawings, a container 21 comprises a moulded synthetic tube 22 provided with an integral shelf 23 which divides the bore of the tube into two portions 22*a* and 22*b*. The end of the portion 22*b* is sealed with a plug 24 and the other end of the tube, in the portion 22*a*, is arranged to receive a closure, for example that shown in FIG. 3. A surface 23*a*, forms a sealing surface for closing a passageway or passageways provided in the closure and the shelf 23 is shaped to provide a seal with closure between the portions 23*a* and 22*b*. In this case, the shelf is crescent shaped.

Figure 8:
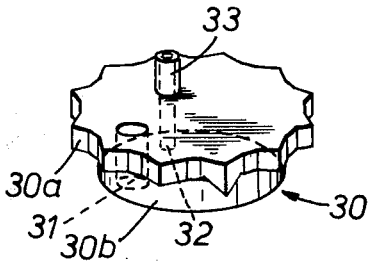
FIG. 8 is a perspective view of a closure which is a modification of that shown in FIG. 3.
Figure 7:
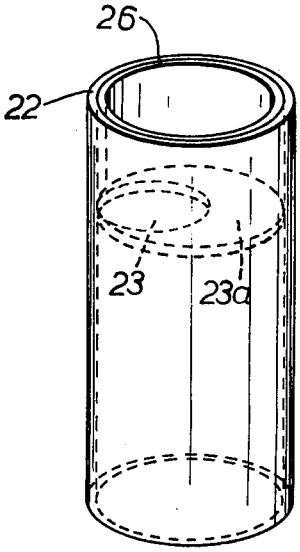
FIG. 7 is a perspective view of a still further container.

FIG. 7 shows an alternative arrangement for providing the shelf 23. In this case, a sleeve 26 provided with the shelf 23 is inserted into the bore of the tube 2. This arrangement allows the tube to be moulded with an integral plug closing one end or alternatively to be merely a piece of right cylindrical tubing fitted at a later stage with a plug, the sleeve 26 and a suitable closure. One suitable closure is shown in FIG. 3, but it may be modified as shown in FIG. 8 where the closure 30 comprises a head portion 30*a* adapted to be gripped by the fingers to allow the closure to be rotated, and a body portion 30*a* of a height at least equal to the height of the container from the sealing surface 23*a* to the top of the tube. Two passageways 31 and 32 extend through the closure, the passageway 32 providing an extension 33 arranged to receive a female member for removing blood from the container. The end of the passageway 31 where it opens through the body portion 30*b* into the container has a reduced diameter which is arranged to wipe the tip of an instrument used to insert blood into the container through the pasageway 31.

The advantage of using a male extension on the closure to receive a female sampling member is that the exterior of the female sampling member will not be contaminated with blood and is therefore safe to handle. It also means that the wiping member in the passageway can be dispensed with if desired.

Indicator marks can again be provided on the closure and the container to ensure easy alignment of the closure in the sealed and unsealed positions.

The number of passageways in the closure and their orientation can be selected as desired, and one or more orifices can be provided in the cylindrical side wall of the upper portion of the container if one or more of the passageways ends at the side of the closure rather than the top. Stops can be provided to prevent rotation of the closure in either direction, thereby to ensure that the passageways not being used are sealed against shoulder 3. It also possible to retain the closure in the upper portion of the container by providing a lip around the upper portion which is received in a circumferential groove in the closure. This improves the sealing effect achieved by the surface 3.

When using a closure which has passageways passing from top to bottom of the closure, a cap can be provided to cover the exposed end of the closure to avoid accidental spillage.

Figure 9:
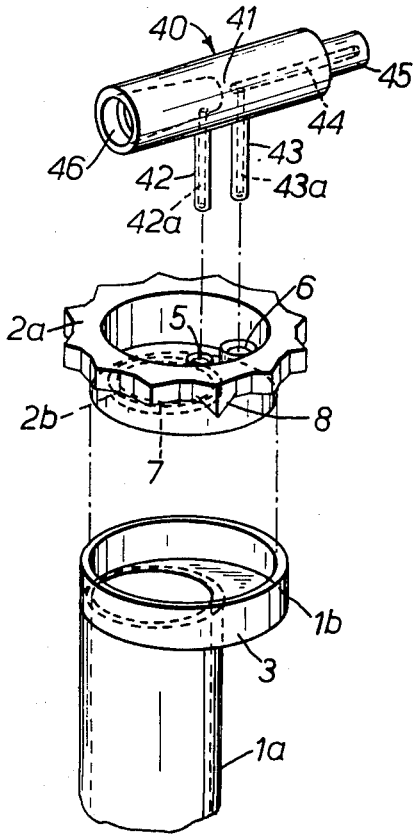
FIG. 9 is an exploded perspective view of a blood collection apparatus.

Further precautions to avoid the spread of infection due to contact with contaminated blood can be taken and FIG. 9 shows one such arrangement. Basically this comprises the container 1 and closure 2 of the first embodiment, but any of the other containers could be used. Means are provided on the closure 2 to allow liquid, for example blood, to be aspirated directly into the container and be expelled directly therefrom. This is achieved by using an adaptor 40 which comprises a body portion 41 and two depending tubes 42, 43. The bore 43*a* of the tube 43 extends into the body portion 41 and connects with a further bore 44 which extends transversely to the bore 43*a* through an extension 45 of the adapter 40. The external surface of the extension 45 is tapered and arranged to sealingly receive the shank of a disposable hypodermic needle.

The bore 42*a* of the tube 42 also extends into the body portion 41 where is connects with another bore 46 which extends transversely of the bore 42*a* and generally in the opposite direction to the bore 44.

The interior of the bore 46 is tapered and arranged to receive the tip of a hypodermic syringe or other aspirating device.

The tubes 42, 43 are of such a length as to extend through the passageways in the closure and hence it is preferred that both passageways are provided with means for wiping the exterior of the tubes 42, 43 on removal of the adaptor 40 from the closure.

In use, a hypodermic needle and a syringe are attached to the adaptor, the closure is rotated to open the container and the adpator placed in position on the closure with the tubes 42, 43 extending through the passageways in the closure. The needle is inserted in a vein and the syringe is then operated to withdraw air from the container through tube 42 and blood is thus drawn directly into the container through the needle and tube 43.

Once the sample has been put into the container, the adaptor is removed and the closure rotated to close the container.

A sample of blood can be dispensed from the container in a similar manner with the tube inverted.

Various modifications may be made especially to the closure and the embodiments described are not intended to be limiting. In addition, as regards FIGS. 6 and 7, the shelf can extend completely over the area of the bore of the tube but be provided with one or more eccentrically disposed orifices to allow access between the portions of the tube, if more than one orifice is provided, it will be necessary to provide a corresponding number of sealing rings on the bottom of the closure corresponding to the sealing ring 7.

What is claimed is:

1. Apparatus for storing a fluid or the like, comprising a. a container having first and secnd portions, and means defining a sealing surface at the junction between said first and second container portions, and b. a closure member mounted in said first container portion, said closure member containing at least one passageway for the fow of fluid to and from said second container portion, respectively, said closure member being movable relative to said container between closed and opened positions in which said passageway is sealed from and is in communication with said second container portion, respectively.

2. Apparatus according to claim 1, wherein the cross-sectional area of the first portion of the container is greater than the cross-sectional area of the second portion.

3. Apparatus according to claim 2, wherein the first and second portions are both cylindrical and the diameter of the first portion is greater than the diameter of the second portion.

4. Apparatus according to claim 2, wherein the first portion is eccentically disposed in relation to the second portion.

5. Apparatus according to claim 2, wherein the first and second portions are co-axial.

6. Apparatus according to claim 5, wherein at least one channel is provided between said first and second portions, the channel opening on to the sealing surface.

7. Apparatus according to claim 1, wherein the sealing surface is formed on a projection in the bore of the container.

8. Apparatus according to claim 1, wherein the closure is provided with means providing a seal between the closure and the junction between said first and second portions.

9. Apparatus according to claim 8, wherein said sealing means comprises a member depending from said closure kenard said second portion.

10. Apparatus according to claim 8, wherein said passageway in the closure is provided with means for wiping the exterior surface of a member, extending in use, through the passageway.

11. Apparatus according to claim 10, wherein said wiping means comprises a portion of reduced diameter in the passageway.

12. Apparatus according to claim 1, wherein the closure is provided with two passageways and further comprising an adaptor arranged to be fitted to the closure for directly transferring liquid to and from the container.

13. Apparatus according to claim 12, wherein the adaptor comprises a body portion provided with two separate bores extending in opposite directions, and two depending tubular members arranged to be received in the passageways of the closure, the bore of each of the tubular members communicating with a respective one of the two bores in the body portion.

14. Apparatus according to claim 13, wherein one of the bores in the body portion tapers toward the interior of the body portion.

15. Apparatus according to claim 13, wherein the body portion is provided with an extension for receiving a sampling member, the other of the bores extending through the extension.

16. Apparatus according to claim 15, wherein the external surface of the extension is tapered.

* * * * *